US005939247A

United States Patent [19]

Hirosawa et al.

[11] Patent Number: 5,939,247

[45] Date of Patent: Aug. 17, 1999

[54] SILVER HALIDE PHOTOGRAPHIC MATERIAL AND A PROCESS FOR FORMING IMAGES

[75] Inventors: Toshio Hirosawa; Kouji Katsube; Toshiko Nakamura; Yoshiro Hayafuchi; Katsuyuki Arasawa; Junichi Komiyama; Tsuyoshi Fujita; Noboru Sonda, all of Kanagawa, Japan

[73] Assignee: Oriental Photo Industrial Co., Ltd., Hiratsuka, Japan

[21] Appl. No.: 09/105,241

[22] Filed: Jun. 26, 1998

[30] Foreign Application Priority Data

Oct. 29, 1997 [JP] Japan ..... 9-312843

[51] Int. Cl.[6] ..... G03C 1/34

[52] U.S. Cl. ..... 430/607; 430/613; 430/614; 430/615

[58] Field of Search ..... 430/607, 613, 430/614, 615

[56] References Cited

U.S. PATENT DOCUMENTS

| | | | |
|---|---|---|---|
| 3,770,431 | 11/1973 | Gates, Jr. et al. | 430/214 |
| 4,952,485 | 8/1990 | Shibahara et al. | 430/607 |
| 4,985,351 | 1/1991 | Matejec et al. | 430/607 |
| 5,728,511 | 3/1998 | Hirosawa et al. | 430/356 |

FOREIGN PATENT DOCUMENTS

| | | |
|---|---|---|
| 46-34675 | 10/1971 | Japan . |
| 48-38418 | 11/1973 | Japan . |
| 51-23908 | 7/1976 | Japan . |
| 6-505580 | 6/1994 | Japan . |

*Primary Examiner*—Hoa Van Le
*Attorney, Agent, or Firm*—Flynn, Thiel, Boutell & Tanis, P.C.

[57] ABSTRACT

The present invention provides a silver halide photographic material which can give a black-and-white picture by the use of dye images even when processed with a color developer substantially free from benzyl alcohol, and little suffers from the deterioration of photographic characteristics by harmful gas such as formaldehyde; and a process for forming images.

Specifically, a silver halide photographic material comprising a base and at least one silver halide emulsion layer formed on the base, wherein the silver chloride content of the grainy silver halide constituting the silver halide emulsion layer is 95 mole % or above; the silver halide emulsion layer contains a yellow coupler, a magenta coupler and a cyan coupler; and the silver halide emulsion layer and/or other hydrophilic colloid layer contains a specific compound; and a process for forming images which comprises processing this silver halide photographic material with a color developer substantially free from benzyl alcohol.

4 Claims, No Drawings

SILVER HALIDE PHOTOGRAPHIC MATERIAL AND A PROCESS FOR FORMING IMAGES

BACKGROUND OF THE INVENTION

1. Field of the Invention

The present invention relates to a silver halide photographic material and a process for forming images, particularly a black-and-white photographic material involving the use of dye images which can be processed with a color developer substantially free from benzyl alcohol and little suffers from the deterioration of photographic characteristics by harmful gas such as formaldehyde and a process for forming images.

2. Description of the Prior Art

It is a usual practice in the recent daily life to use furniture or building materials modified with formaldehyde, adhesives containing formaldehyde as the curing agent, articles processed with formaldehyde resins, formaldehyde-tanned leather products, clothes containing formaldehyde as a bactericide or bleach, and so on. Therefore, the chance has increased that photographic materials come into contact with formaldehyde discharged from these materials or products.

In general, a silver halide color photographic material comprises a base and several silver halide emulsion layers formed on the base containing couplers which react with an oxide of a color developing agent to form dyes, i.e., silver halide layers which exhibit sensitivity for blue, green and red lights and contain a yellow coupler, a magenta coupler and a cyan coupler, respectively, and in these silver halide emulsion layers, images of yellow, magenta and cyan dyes are respectively formed through exposure and color development.

In order to obtain a good color picture, such a multilayer color photographic material is required to be well-balanced among the silver halide emulsion layers with respect to sensitivity and tone, and is desired not to cause any change in the photographic performance during storage up to color development, inclusive of the terms before and after exposure.

When a silver halide color photographic material comes into contact with formaldehyde gas before color development, however, the couplers are consumed by the reaction with formaldehyde through the formation of undesirable reaction products, which brings about deterioration of photographic characteristic such as lowered densities of formed dyes or significant color stain or fog. The deterioration of the photographic characteristic by formaldehyde gas is remarkable when a so-called four-equivalent coupler having an active methylene group is used. In particular, magenta couplers are liable to be more significantly affected by formaldehyde.

In order to inhibit the deterioration of the photographic characteristic by formaldehyde gas, attempts have been made to incorporate compounds reactive with formaldehyde into coupler-in-emulsion type silver halide color photographic materials. Up to this time, many compounds have been proposed in, e.g., JP-B 46-34675, 48-38418 and 51-23908 and U.S. Pat. No. 3,770,431 as the compounds effective in protecting the silver halide color photographic materials containing oil-soluble four equivalent magenta couplers from the deterioration of the photographic characteristic by formaldehyde gas. However, these compounds had disadvantages in that the power of immobilizing formaldehyde gas was too poor to attain any satisfactory effect and that the addition of the compounds in large amounts was causative of lowering in the film properties of the photographic material.

Meanwhile, photographic systems forming black-and-white images by using combinations of cyan, magenta and yellow dyes have also been known (see, e.g., JP-A 6-505580). In such a system, dyes are made from a mixture of cyan, magenta and yellow color-forming couplers during color development, and the couplers give neutral images when reacted with an oxidized color developing agent. However, the above patent document (JP-A 6-505580) is silent on formaldehyde gas or compounds reactive with formaldehyde gas.

The inventors of the present invention have found that a magenta coupler is affected by formaldehyde gas even in such photographic systems of forming black-and-white images by using combinations of cyan, magenta and yellow dyes.

Further, the formation of black-and-white images by using silver images according to the prior art was conducted through development with a black-and-white developing agent such as hydroquinone. However, there are few laboratories and camera shops wherein such development can be conducted. Meanwhile, the processing of color papers is currently conducted by using a color developer substantially free from benzyl alcohol, and machines suitable for this processing have widely been spread to many laboratories and camera shops. Black-and-white image forming materials processable by such machines are favorable under these circumstances.

The first object of the present invention is to provide a silver halide photographic material giving a black-and-white picture by the use of dye images in which the contained magenta coupler is little affected by formaldehyde gas.

The second object of the present invention is to provide a process for forming images which can give a black-and-white picture by the use of dye images through development with a color developer substantially free from benzyl alcohol.

SUMMARY OF THE INVENTION

The above objects of the present invention can be attained by a silver halide photographic material comprising a base and at least one silver halide emulsion layer formed on the base, wherein the silver chloride content of the silver halide grain constituting the silver halide emulsion layer is 95 mole % or above; the silver halide emulsion layer contains a yellow coupler, a magenta coupler and a cyan coupler; and the silver halide emulsion layer and/or other hydrophilic colloid layer contains at least one compound represented by the general formula (I) or (II), and a process for forming images which comprises developing this silver halide photographic material with a color developer substantially free from benzyl alcohol:

Chemical Formula (I)

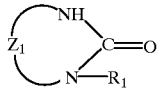

wherein $R_1$ is hydrogen, $C_1$–$C_4$ alkyl or acyl; and $Z_1$ is an ethylene chain or a trimethine chain, Chemical Formula (II)

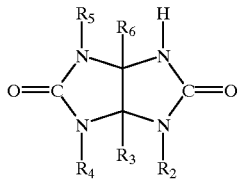

wherein $R_2$, $R_3$, $R_4$, $R_5$ and $R_6$ are each hydrogen, a $C_1$–$C_4$ alkyl, an aryl or an aralkyl.

In other words, the invention provides a silver halide photographic material comprising a base and at least one silver halide emulsion layer formed on the base, in which a silver chloride content of silver halide grain of the silver halide emulsion layer is 95 mole % or above; the silver halide emulsion layer contains a yellow coupler, a magenta coupler and a cyan coupler; and the silver halide emulsion layer contains at least one compound selected from the group consisting of compounds having the above defined formula (I) and (II).

It is preferred that the material comprises the base, at least one silver halide emulsion layer and a hydrophilic colloid layer, in which at least one of the silver halide emulsion layer and the hydrophilic colloid layer contains at least one compound selected from the group consisting of compounds having the formulae (I) and (II).

It is preferred that the hydrophilic colloid layer is disposed on the silver halide emulsion layer and the hydrophilic colloid layer contains at least one compound selected from the group consisting of compounds having the formulae (I) and (II).

The invention provides a process for forming images, which comprises the steps of exposing the material as aforementioned to light carrying images and developing the material with a color developer substantially free from benzyl alcohol.

DESCRIPTION OF EMBODIMENTS

The silver halide grain constituting the silver halide emulsion to be used in the present invention must be one comprising at least 95 mole % of silver chloride, preferably silver chloride—silver bromide substantially free from silver iodide.

The mean particle size of the silver halide grain is preferably 3 $\mu$m or below (in terms of mean particle diameter with respect to spherical or approximately spherical grain or mean edge length with respect to cubic grain, and based on the projection area), though it is not particularly limited.

It is of no matter whether the particle size distribution of the grainy silver halide is narrow or wide.

The silver halide grain may take a regular crystal form such as cube or octahedron, an irregular crystal form such as sphere or flake, or a composite of two or more of these crystal forms. Further, the grainy silver halide may be a mixture of grain of various crystal forms.

Furthermore, the silver halide emulsion may be one wherein silver halide flakes having a diameter which is at least 5 times the thickness thereof account for at least 50% of the whole projected area.

It is of no matter whether the grainy silver halide is composed of grain which form latent images mainly on the surfaces thereof or those which form latent images mainly inside them.

The silver halide grain may have a layer structure composed of inner and outer layers different from each other in the composition of halogens. Alternatively, silver halide grain of different compositions of halogens may be epitaxially junctioned with each other.

The silver halide grain constituting the silver halide emulsion is preferably one composed of grain wherein a localized silver halide layer having a silver bromide content of 30 to 60 mole % is formed by epitaxial growth locally on the surface of each grain, particularly at a corner thereof. It is still preferable that the amount of silver constituting the localized layer be 0.5 to 5% based on the total amount of silver constituting the silver halide grain. A process for producing such epitaxial silver halide grain is described in EP 273,430 A.

The silver halide emulsion to be used in the present invention can be prepared by the processes described in P. Glafkides, "Chimie et Physique Photographique" (Paul Montel, 1967), G. F. Duffin, "Photographic Emulsion Chemistry" (The Focal Press, 1966), V. L. Zelikman et al., "Making and Coating Photographic Emulsion" (The Focal Press, 1964), and so on. In other words, the silver halide emulsion may be prepared by any of acid processes, neutral processes and ammonia processes, and the reaction of a soluble silver salt with a soluble halogen salt may be conducted by any of cocurrent, countercurrent and simultaneous-mixing processes or a combination of two or more of these processes.

A so-called "controlled double-jet process" by which the pAg of the solution forming silver halides can be kept at a constant level can be employed as one of the simultaneous-mixing processes. The employment of this process gives silver halide grain having a regular crystal form and nearly uniform particle sizes.

A mixture of two or more silver halide emulsions which have separately been prepared may also be used.

One or more members selected from among cadmium salts, zinc salts, lead salts, thallium salts, iridium salts and complex salts thereof, rhodium salts and complex salts thereof, iron salts and complex salts thereof, and so on may be present in the step of forming silver halide grain or the step of physically ripening them.

In general, the silver halide emulsion is chemically sensitized. The chemical sensitization may be conducted by sulfur sensitization with a sulfur compound reactive with activated gelatin or silver (such as one selected from among thiosulfate salts, thioureas, mercapto compounds, rhodanines and so on), reductive sensitization with a reducing substance (such as one selected from among stannous salts, amines, hydrazine derivatives, formamidine sulfinate, silane compounds and so on), noble metal sensitization with a noble metal compound (such as one selected from among complex salts of gold, platinum, iridium, palladium and so on), or a combination of two or more of them.

Next, the compound represented by the general formula (I) will be described.

Chemical Formula (I)

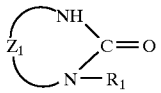

wherein $R_1$ is hydrogen, a $C_1$–$C_4$ alkyl (such as methyl, ethyl, propyl or ethoxymethyl) or an acyl (such as acetyl or benzyl); and $Z_1$ is an ethylene chain or a trimethine chain.

Chemical Formula (II)

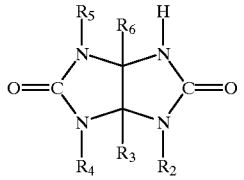

wherein $R_2$, $R_3$, $R_4$ $R_5$ and $R_6$ are each hydrogen, $C_1$–$C_4$ alkyl (such as methyl, ethyl or propyl), aryl (such as phenyl), or aralkyl (such as benzyl).

Specific examples of the compound represented by the general formulae (I) and (II) are as follows:

I-1

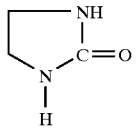

I-2

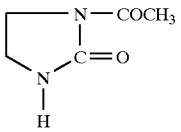

I-3

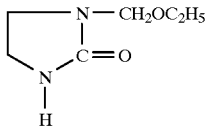

I-4

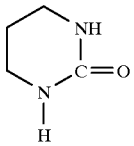

II-1

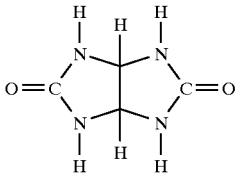

II-2

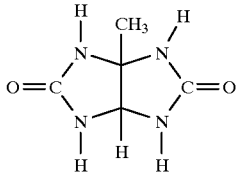

-continued

II-3

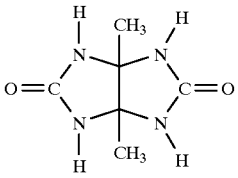

II-4

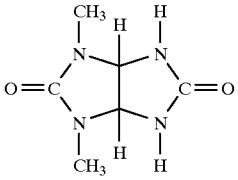

II-5

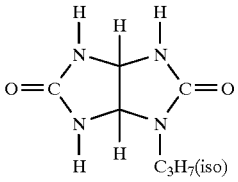

II-6

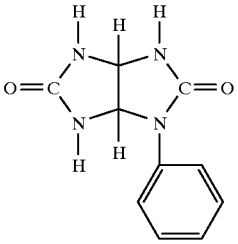

II-7

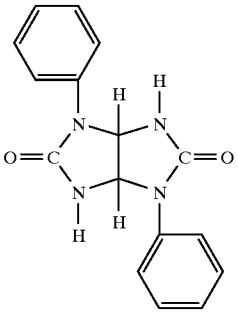

II-6

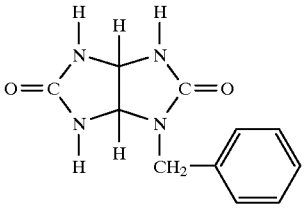

The above compounds are commercially available, or can be prepared by the processes described in U.S. Pat. Nos. 3,187,004 and 3,242,044.

The above-mentioned compounds can be obtained commercially, or the compounds can be synthesized by the method shown by the descriptions of U.S. Pat. No. 3,187,004 or U.S. Pat. No. 3,242,044.

One or more of the compounds represented by the general formulae (I) and (II) are mixed into the silver halide emulsion layer containing a yellow coupler, a magenta coupler and a cyan coupler and/or other hydrophilic colloid layer. Preferably, one or more of the compounds represented by the general formulae (I) and (II) in the present invention are mixed into the silver halide emulsion layer and a hydrophilic colloid layer. It is cited that such a hydrophilic colloid layer as a protective layer, a interlayer, an ultraviolet absorbing layer, a yellow filter layer, an antihalation layer, and an antistatic layer. It is effective that the compounds represented by the general formulae (I) and (II) are contained in the hydrophilic colloid layer, preferably in a layer of the photographic material nearest to the open air, for example, the protective layer.

The compounds represented by the general formulae (I) and (II) in present invention are enough added and contained in these layers, so as the compounds dissolved in such a suitable dissolvent, for example, as an water and a methanol are added into a coating fluid to form layers. Although the compounds may be added at any step, the compounds are desirably added together with the other additive or just before coated.

The amount of the compounds to be added is preferably effective 0.1 to 1.0 g in a silver halide emulsion layer and 0.1 to 1.0 g in a hydrophilic unexposed colloid layer per $m^2$ of the photographic material and 0.1 to 2.0 g in a whole layer of the photographic material.

It is preferable that the silver halide emulsion be spectrally sensitized by at least one sensitizing dye represented by the general formula (III), at least one sensitizing dye represented by the general formula (IV) and at least one sensitizing dye represented by the general formula (V) or (VI).

Chemical formula

III

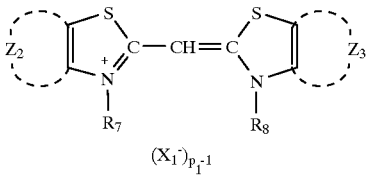

$(X_1^-)_{p_1-1}$ (IV)

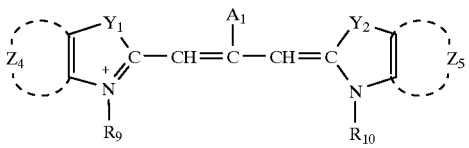

$(X_1^-)_{p_2-1}$ (V)

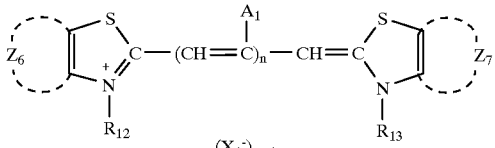

$(X_1^-)_{p_3-1}$

-continued (VI)

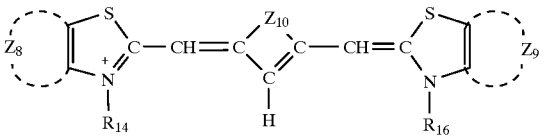

$(X_4^-)_{q-1}$

In the general formula (III), $R_7$ and $R_8$ are each $C_1$–$C_6$ alkyl (such as methyl, ethyl, n-propyl, isopropyl, n-butyl, isobutyl, n-hexyl, isohexyl or the like), $C_1$–$C_4$ substituted alkyl [for example, hydroxyalkyl (such as 2-hydroxyethyl, 3-hydroxypropyl, 2-hydroxypropyl or the like), sulfoalkyl (such as 2-sulfoethyl, 3-sulfopropyl, 3-sulfobutyl, 4-sulfobutyl or the like), or carboxyalkyl (such as 2-carboxyethyl, 3-carboxypropyl, 3-carboxybutyl, 4-carboxybutyl or the like)], or aralkyl (such as benzyl, 2-phenylethyl or the like), with cases wherein either of $R_7$ and $R_8$ is a substituted alkyl being preferable; $Z_2$ and $Z_3$ are each a non-metallic atomic group necessary for forming a benzene or naphthalene nucleus which may have a substituent (for example, halogeno, alkyl, alkoxy, aryl, cyano, alkoxycarbonyl, trifluoromethyl., alkylsulfonyl, alkylsulfamoyl, acylamino, alkylcarbamoyl, acetoxy or the like); $X_1$ is an ordinary anionic group (for example, chloride ion, bromide ion, iodide ion, perchlorate ion, p-toluenesulfonate ion, ethylsulfate ion or the like); and $p_1$ is 1 or 2, with the proviso that when $p_1$ is 1, an inner salt is formed.

In the general formula (IV), $R_9$ and $R_{10}$ are each optionally sulfonated $C_1$–$C_6$ alkyl (such as methyl, ethyl, n-propyl, isopropyl, n-butyl, isobutyl, n-hexyl, 2-sulfoethyl, 3-sulfopropyl, 3-sulfobutyl or the like); Al is hydrogen, $C_1$–$C_3$ alkyl (such as methyl, ethyl, n-propyl, isopropyl or the like), or aryl (such as phenyl or the like); $Y_1$ and $Y_2$ are each sulfur, oxygen, selenium or N—$R_{11}$, with $R_{11}$ being $C_1$–$C_3$ alkyl (such as methyl, ethyl, n-propyl, isopropyl or the like); $Z_4$ and $Z_5$ are each a non-metallic atomic group necessary for forming a benzene or naphthalene ring which may have a substituent (for example, halogeno, alkyl, alkoxy, aryl, carbonyl, alkoxycarbonyl, cyano or the like); $X_2$ is an anion (such as chloride ion, bromide ion, iodide ion, perchlorate ion, p-toluenesulfonate ion, ethylsulfate ion or the like); and $p_2$ is 1 or 2, with the proviso that when $p_2$ is 1, an inner salt is formed.

In the general formulas (V) and (VI), $R_{12}$, $R_{13}$, $R_{14}$ and $R_{15}$ are each $C_1$–$C_6$ alkyl (such as methyl, ethyl, n-propyl, isopropyl, n-butyl, isobutyl, n-hexyl, isohexyl or the like), $C_1$-$C_4$ substituted alkyl [for example, hydroxyalkyl (such as 2-hydroxyethyl, 3-hydroxypropyl, 2-hydroxypropyl or the like), sulfoalkyl (such as 2-sulfoethyl, 3-sulfopropyl, 3-sulfobutyl, 4-sulfobutyl or the like) or carboxyalkyl (such as 2-carboxyethyl, 3-carboxypropyl, 3-carboxybutyl, 4-carboxybutyl or the like)] or aralkyl (such as benzyl, 2-phenylethyl or the like), with cases wherein either of $R_{12}$ and $R_{13}$ is substituted alkyl and cases wherein either of $R_{14}$ and $R_{15}$ is substituted alkyl being preferable; $A_2$ is hydrogen, $C_1$–$C_3$ alkyl (such as methyl, ethyl, n-propyl, isopropyl or the like) or aryl (such as phenyl or the like); $Z_6$, $Z_7$, $Z_8$ and $Z_9$ are each a non-metallic atomic group necessary for forming a benzene or naphthalene nucleus which may have a substituent (for example, halogeno, alkyl, alkoxy, aryl, cyano, alkoxycarbonyl, trifluoromethyl, alkylsulfonyl, alkylsulfamoyl, acylamino, alkylcarbamoyl, acetoxy or the like); $Z_{10}$ is a non-metallic atomic group necessary for forming a six-membered ring which may have a substituent (such as alkyl or the like); $X_3$ and $X_4$ are each an ordinary anionic group (such as chloride ion, bromide ion, iodide ion, perchlorate ion, p-toluenesulfonate ion, ethylsulfate ion or the like); n is 2; and $p_3$ or q is 1 or 2, with the proviso that when $p_3$ and q are 1, an inner salt is formed.

Specific examples of these sensitizing dyes are described in JP-A 10-20432 (corresponding to U.S. Pat. No. 5,728,511).

These sensitizing dyes are used each in a concentration of $10^{-6}$ to $10^{-3}$ mol per mol of the silver halide contained in the silver halide emulsion. In adding such sensitizing dyes to the silver halide emulsion, the sensitizing dyes may be dispersed directly in the silver halide emulsion or alternatively they may be added to the emulsion in a state dissolved in a suitable solvent such as methyl alcohol, ethyl alcohol, acetone, N,N-dimethylformamide, ethyl acetate or a mixture of two or more of them or a solution of a surfactant in such a solvent.

The sensitizing dyes can be added to the silver halide emulsion during the formation of silver halide grain or after the completion of physical ripening. It is preferable that the sensitizing dyes be added to the silver halide emulsion after the completion of physical ripening and before, during or after chemical ripening. The above sensitizing dyes may be used each alone or as a mixture of two or more of them. Such a mixture is often used particularly for the purpose of super-sensitization.

The emulsion may contain, in addition to the above sensitizing dyes, a dye which does not exhibit any spectral sensitization effect in itself or a substance which scarcely absorbs visible light but exhibits a supersensitization effect. For example, it may contain aminostyryl compounds substituted with nitrogenous heterocyclic groups (as described in, e.g., U.S. Pat. Nos. 2,933,390 or 3,635,721), aromatic organic acid-formaldehyde condensates (as described in, e.g., U.S. Pat. No. 3,743,510), cadmium salts, azaindene compounds or the like.

The yellow coupler usable in the present invention includes oil-protected acylacetamide couplers. Specific examples thereof are described in, e.g., U.S. Pat. Nos. 2,407,210, 2,875,057 and 3,265,506. The use of a two equivalent yellow coupler is preferable in the present invention. Such a two-equivalent yellow coupler includes oxygen atom leaving ones as described in, e.g., U.S. Pat. Nos. 3,408,194, 3,447,928, 3,933,501 and 4,401,752, and nitrogen atom leaving ones as described in, e.g., JP-B 58-10739, U.S. Pat. Nos. 4,022,620 and 4,326,024, Research Disclosure 18,053 (April, 1987), GB 1,425,020, and DE 2,219,917 A1, 2,261,361 A1, 2,329,587 A1 and 2,433,812 A1.

α-Pivaloylacetanilide couplers are characterized by the excellent fastness of formed dyes, while α-benzoylacetanilide ones are characterized by the excellent coupling properties.

The magenta coupler usable in the present invention includes oil-protected indazolone and cyanoacetyl couplers, and preferable examples of the coupler include 5-pyrazolone couplers and pyrazoloazole couplers such as pyrazolotriazole ones. Among 5-pyrazolone couplers, those substituted with arylamino or acylamino at the 3-position are preferable from the standpoints of the hue of formed dye and the rate of coupling. Specific examples of such 5-pyrazolone couplers include those As described in U.S. Pat. Nos. 2,311,082, 2,343,703, 2,600,788, 2,908,573, 3,062,653, 3,152,896 and 3,936,015. The use of a two-equivalent 5-pyrazolone coupler is particularly preferable and the leaving group includes nitrogen atom leaving ones as described in U.S. Pat. No. 4,310,619 and arylthio groups as described in U.S. Pat. No. 4,351,897. 5-Pyrazolone couplers having a ballast group as described in EP 73,636 are preferable owing to their high coupling reactivity. The pyrazoloazole couplers include pyrazolo[1,5-b][1,2,4]triazoles described in EP 119,860, pyrazolobenzimidazoles described in U.S. Pat. No. 3,369,897, pyrazolotetrazoles described in Research Disclosure 24,220 (June, 1984), and pyrazolopyrazoles described in Research Disclosure 24,230 (June, 1984). Further, imidazopyrazoles and pyrazolo[1,5-b] [1,2,4]triazoles described in JP-A 59-162548 are preferable, because the formed dyes little cause secondary absorption of yellow and are excellent in lightfastness.

The cyan coupler usable in the present invention includes oil-protected naphthol and phenol couplers. The naphthol couplers include those described in U.S. Pat. No. 2,474,293, and preferable examples of the couplers include oxygen atom leaving, highly active two equivalent ones as described in U.S. Pat. Nos. 4,052,212, 4,143,396, 4,228,233 and 4,296,200. The phenol couplers include those described in U.S. Pat. Nos. 2,369,929, 2,423,730, 2,772,162, 2,801,171, 2,895,826 and so on. It is preferable to use a cyan coupler resistant to temperature and humidity. Examples of such a cyan coupler include phenol couplers described in U.S. Pat. No. 3,772,022, 2,5-diacylaminophenol couplers described in U.S. Pat. Nos. 2,772,162, 3,758,308, 4,126,396 and 4,327,137 and JP-A 59-166956, and 2-phenylureido-5-acylaminophenol couplers described in U.S. Pat. Nos. 3,446,622, 4,333,999, 4,451,559, 4,427,767 and so on.

Specific examples of the couplers to be favorably used in the present invention include those described in JP-A 10 20432.

The couplers can be introduced into the silver halide emulsion by various dispersion processes. Specifically, the introduction can be conducted by, e.g., solid dispersion processes, alkaline dispersion processes, preferably latex dispersion processes, still preferably oil-in-water dispersion processes. According to the oil-in-water dispersion process, the couplers are dissolved in either a high-boiling organic solvent having a boiling point of 175° C. or above or a low-boiling cosolvent or a mixture of both, and the resulting solution is finely dispersed in an aqueous medium such as water or an aqueous solution of gelatin in the presence of a surfactant. The high-boiling organic solvent may be selected from among those described in U.S. Pat. No. 2,322,027 and so on. The dispersion may be accompanied with phase inversion. If necessary, the resulting emulsion may be freed from the cosolvent or reduced in the content of the cosolvent by distillation, noodle washing, ultrafiltration or the like prior to the application of the emulsion to a base.

In the silver halide photographic material of the present invention, it is preferable that a yellow coupler (Y), a magenta coupler (M) and a cyan coupler (C) be used at a Y/M/C molar ratio of 2.5 to 4.5:1:2.0 to 4.5.

Example of the high-boiling organic solvent include phthalates (such as dibutyl phthalate, dicyclohexyl phthalate, di-2-ethylhexyl phthalate, didodecyl phthalate and so on); phosphates and phosphonates (such as triphenyl phosphate, tricresyl phosphate, 2-ethylhexyl diphenyl phosphate, tricyclohexyl phosphate, tri-2-ethylhexyl phosphate, trididecyl phosphate, tributoxyethyl phosphate, trichloropropyl phosphate and di-2-ethylhexyl phenyl phosphate); benzoates (such as 2-ethylhexyl benzoate, dodecyl benzoate, 2-ethylhexyl p-hydroxybenzoate and so on); amides (such as diethyldodecanamide, N-tetradecylpyrrolidone and so on); alcohols and phenols (such as isostearyl alcohol, 2,4-di-t-amylphenol and so on); aliphatic carboxylic acid esters (such as dioctyl azelate, glycerol tributyrate, isostearyl lactate, trioctyl citrate and so on); aniline derivatives (such as N,N-dibutyl-2-butoxy-5-t-octylaniline and so on); hydrocarbons (such as paraffin, dodecylbenzene, diisopropylnaphthalene and so on); and so on.

The cosolvent may be one having a boiling point of about 30 to 60° C., and specific examples thereof include ethyl acetate, butyl acetate, ethyl propionate, methyl ethyl ketone, cyclohexanone, 2-ethoxyethyl acetate, dimethylformamide and so on.

The procedures and effects of the latex dispersion processes and specific examples of the latex for impregnation are disclosed in U.S. Pat. No. 4,199,363 and DE 2,541,274 A1 and 2,541,230 A1.

Although gelatin is mainly used as the binder or protective colloid constituting the emulsion layer and other hydrophilic colloid layers of the photographic material according to the present invention, the binder or protective colloid may be selected also from among proteins such as gelatin derivatives, albumin and casein; cellulose derivatives such as ethylcellulose and carboxymethylcellulose; saccharide derivatives such as starch derivatives; and hydrophilic homopolymers and copolymers such as polyvinyl alcohol, polyacrylic acid, polyacrylamide, polymethacrylic acid and so on.

The emulsion layer and other hydrophilic layers constituting the photographic material according to the present invention may contain various compounds for the purpose of preventing fogging during production, storage or development, or stabilizing the photographic performance. Such compounds include many compounds known as antifoggant or stabilizer, for example, azoles such as nitroindazoles, nitrobenzimidazoles, mercaptothiazoles, mercaptobenzimidazoles, mercaptothiadiazoles, aminotriazoles, benzotriazoles, and mercaptotetrazoles (particularly 1-phenyl-5-mercaptotetrazole); mercaptotriazines, thio ketone compounds, azaindenes such as triazaindenes, tetraazaindenes (particularly 4-hydroxy-1, 3,3a,7-tetraazaindene), and pentaazaindenes; benzenethiosulfonic acid, benzene-sulfinic acid, benzenesulfonamide and so on. Among these compounds, benzotriazoles and nitroindazoles are particularly preferable. These compounds may be added also to the processing bath used in the development.

The emulsion layer and other hydrophilic colloid layers constituting the photographic material according to the present invention may contain hydroquinone derivatives, aminophenol derivatives, gallic acid derivatives, ascorbic acid derivatives or the like as a color fog restrainer.

The emulsion layer and other hydrophilic colloid layers constituting the photographic material according to the present invention may contain an inorganic: or organic hardening agent. Examples of the hardening agent include chromium salts (such as chrome alum and so on); N-methylol compounds, dioxane derivatives, active vinyl compounds (such as 1,2,5-triacryloylhexahydro-s-triazine, 1,3-vinylsulfonyl-2-propanol and so on), active halogen compounds (such as 2,4-dichloro-6-hydroxy-s-triazine and so on) and mucohalogenoic acids (such as mucochloric acid, mucophenoxychloric acid and so on), which may be used each alone or as a mixture of two or more of them.

The emulsion layer and other hydrophilic colloid layers constituting the photographic material according to the present invention may contain surfactants for various purposes, i.e., as coating aid, antistatic agent, slip agent, emulsifier and dispersant, anti-blocking agent, photographic characteristic improver (such as development accelerator, contrasting agent, sensitizing agent and so on) and so on. Example of the surfactants include nonionic surfactants such as saponin, alkylene oxide derivatives (such as polyethylene glycol, polyethylene glycol alkyl ethers and so on), glycidol derivatives (such as polyglycerides of alkenylsuccinic acids, polyglycerides of alkylphenols and so on), fatty acid esters of polyhydric alcohols, alkyl esters of saccharides and so on; anionic surfactants having acid groups (such as carboxyl, sulfo, sulfuric ester, phosphoric ester and so on) such as alkylcarboxylic acid salts, alkyl sulfates and alkyl phosphates; amphoteric surfactants such as amino acids, aminoalkylsulfonic acids, aminoalkylsulfuric acids, phosphoric esters and so on; and cationic surfactants such as aliphatic and aromatic quaternary ammonium salts, heterocyclic quaternary ammonium salts and so on.

The emulsion layer and other hydrophilic colloid layers constituting the photographic material according to the present invention may contain a dispersion of a synthetic polymer which is soluble or difficultly soluble in water, for the purpose of improving the dimensional stability and so on. Examples of the synthetic polymer include homopolymers of alkyl (meth)acrylates, alkoxyalkyl (meth)acrylates, (meth)acrylamide, vinyl esters, glycidyl (meth)acrylate, acrylonitrile, styrene and so on; copolymers each comprising two or more of them; and copolymers each comprising one or more of the above monomers and at least one member selected from acrylic acid, methacrylic acid, $\alpha,\beta$-unsaturated dicarboxylic acids, styrenesulfonic acid and so on.

The above hydrophilic colloid layers of the photographic material other than the silver halide emulsion layer include surface protecting layer, filter layer, antihalation layer, antistatic layer and so on. The hydrophilic colloid layers such as surface protecting layer may contain a matting agent for the purpose of improving the anti-block properties and the surface state. Examples of the matting agent include fine particles of polymethyl methacrylate, methyl methacrylate-methacrylic acid copolymer, starch, silica and magnesium oxide as described in U.S. Pat. Nos. 2,701,245, 2,992,101, 4,142,894 and 4,396,706. Further, the surface protecting layer may contain a silicone compound as described in U.S. Pat. Nos. 3,489,576 or 4,047,958, a colloidal silica as described in JP-B 56-231:39, paraffin wax, a higher fatty acid ester or the like.

The hydrophilic colloid layers of the photographic material according to the present invention may contain an ultraviolet absorber. Examples of such an ultraviolet absorber include aryl-substituted benzotriazoles as described in U.S. Pat. Nos. 3,533,794 and 4,236,013, JP-B 51-6540 and EP 57,160; butadienes as described in U.S. Pat. No. 4,195,999; cinnamic acid esters as described in U.S. Pat. Nos. 3,705,805 and 3,707,375; benzophenones as described in U.S. Pat. No. 3,215,230 and GB 1,321,355; and polymers having ultraviolet absorbing groups as described in U.S. Pat. Nos. 3,761,272 and 4,431,726. Alternatively, the hydrophilic colloid layers may contain an ultraviolet-absorbing fluorescent whitening agent as described in U.S. Pat. Nos. 3,499,762 and 3,700,455.

The hydrophilic colloid layers of the photographic material according to the present invention may contain a water-soluble dye as a filter dye or for the prevention of irradiation or the like. Such a water-soluble dye includes oxonol dyes, hemioxonol dyes, styryl dyes, merocyanine dyes, cyanine dyes and azo dyes, among which oxonol dyes, hemioxonol dyes and merocyanine dyes are useful.

The emulsion layer and other hydrophilic colloid layers constituting the photographic material of the present invention may contain one or more anti-fading agents. Examples of the anti-fading agents include phenols and phenyl ethers as described in JP-A 59-125732, metal complexes as described in JP-A 60-97353, hindered amines and hindered phenols as described in JP-A 62-115157, metal complexes as described in JP-A 61-140941, and so on.

Further, the emulsion layer and other hydrophilic colloid layers constituting the photographic material of the present invention may contain, as a plasticizer, a polyol such as trimethylolpropane, pentanediol, butanediol, ethylene glycol or glycerol. Furthermore, the emulsion layer and other hydrophilic colloid layers may contain one or more of fluorescent whitening agents, development accelerators, pH regulators, thickening agents, antistatic agents and so on.

The base constituting the photographic material of the present invention includes films made of synthetic polymers such as cellulose triacetate, cellulose diacetate, nitrocellulose, polystyrene, polyethylene terephthalate, polycarbonate and so on; baryta paper, papers coated and laminated with α-olefin polymers (such as polyethylene or polypropylene); synthetic papers and so on. The base may be colored with a dye or a pigment. When the base is used as a reflector, it is preferable to add a white pigment to the base or the lamination layer. Examples of the white pigment include titanium dioxide, barium sulfate, zinc oxide, zinc sulfide, calcium carbonate, antimony trioxide, white silica pigment, white alumina pigment, titanium phosphate and so on. In particular, titanium dioxide, barium sulfate and zinc oxide are useful.

In general, a substratum is formed on the surface of the base to enhance the adhesion of the photographic emulsion thereto. Prior or posterion to the formation of the substratum, the surface of the base may be treated by corona discharge, irradiation with ultraviolet light or the like. When the base is used as a reflector, a hydrophilic colloid layer containing a white pigment at a high density may be formed between the base and the emulsion layer to thereby improve the whiteness and the sharpness of photographic images.

When a synthetic resin film colored with a white pigment by kneading is used, the resulting photographic material can give a photographic image which is improved in smoothness, gloss and sharpness and is excellent in chromaticness, delineation of shadow and so on. Polyethylene terephthalate and cellulose acetate are particularly useful as the material of the synthetic resin film, while barium sulfate and titanium oxide as the white pigment.

The silver halide photographic material of the present invention can form a black-and-white image through exposure from a black-and-white negative film or a color negative film.

The color developer to be used in the present invention is preferably an aqueous alkali solution containing an aromatic primary amine developing agent as the principal ingredient. Examples of the developing agent include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline and so on.

The color developer may contain a pH buffer selected from the group consistinng of carbonates, borates, phosphates and so on; an antifoggant selected from the group consisting of bromides, iodides and organic antifoggants; or the like. If necessary, the color developer may contain one or more members selected from among water softeners; development accelerators such as alkali metal sulfites, diethylene glycol, polyethylene glycol, quaternary ammonium salts, amines and so on; competitive couplers; fogging agents such as sodium borohydride; auxiliary developing agents such as 1-phenyl-3-pyrazolidone and so on; thickening agents; polycarboxylic acid base chelating agents described in U.S. Pat. No. 4,082,723; antioxidants described in DE 2,622,950 A1; and soon. The term "substantially free from benzyl alcohol" used with respect to the developer means that the benzyl alcohol content (of the developer) is 5 ml/l or below. It is still preferable that the developer be completely free from benzyl alcohol.

After the completion of the color development, the silver halide photographic material of the present invention is generally subjected to bleach. The bleach may be conducted simultaneously with fixing or separately therefrom. Examples of the bleaching agent usable in the present invention include compounds of polyvalent metals such as iron (III), cobalt (III), chromium (VI) and copper (II); peracids; quinones; nitroso compounds and so on. Specific examples thereof include ferricyanides; bichromates; organic acid salts of iron (III) and cobalt (III) such as complex salts thereof with aminopolycarboxylic acids (such as ethylenediaminetetraacetic acid, nitrilotriacetic acid, 1,3-diamino-2-propanoltetraacetic acid and so on) and organic acids (such as citric acid, tartaric acid, malic acid and so on); persulfate salts; manganate salts; nitrosophenol and so on. Among these bleaching agents, iron(III) sodium ethylenediaminetetraacetate and iron(III) ammonium ethylenediaminetetraacetate are particularly useful. Such iron (III) complex salts of ethylenediaminetetraacetic acid are useful for both a bleach bath and a bleach-fix bath. After the color development or the bleach-fix, the photographic material may be washed with water. The color development may be conducted at an arbitrary temperature ranging from 18 to 55° C., preferably at 30° C. or above, particularly preferably at 35° C. or above. The development time ranges from about 1.5 minutes to about 20 seconds. A shorter development time is better. In continuous development, it is preferable to add a replenishing solution in an amount of 100 ml or above, still preferably 160 to 330 ml per square meter of the processed area. The bleach-fix may be conducted at an arbitrary temperature ranging from 18 to 50° C., preferably at 30° C. or above. When the bleach-fix is conducted at 35° C. or above, the processing time can be shortened to one minute or below and the amount of the replenishing solution to be added can be reduced. The washing conducted after color development or bleach-fix is generally completed within one minute. Alternatively, the treatment in a stabilizing bath may be conducted within one minute.

The formed dyes are not only deteriorated by light, heat or moisture, but also deteriorated and faded by mildew during storage. The use of a mildewproofing agent is desirable particularly for a cyan dye, because the dye is liable to be significantly deteriorated by mildew. Specific examples of the mildewproofing agent include 2-thiazolylbenzimidazoles as described in JP-A 57-157244. The mildewproofing agent may be integrally incorporated into the silver halide photographic material or may be added in the development: step. In other words, the mildewproofing agent may be added in an arbitrary step, as far as the agent can coexist with the photographic material after processing.

EXAMPLES

The present invention will now be described by referring to the following Examples.

Example 1

A silver halide emulsion was prepared according to the following formula.

| | | |
|---|---|---|
| Solution I | | |
| deionized water | 1,000 | ml |
| sodium chloride | 4.0 | g |
| inert gelatin | 30 | g |
| citria acid | 2.4 | g |
| Solution II | | |
| 1,3-dimethyl-2-imidazolidinethione (1% aqueous solution) | 2 | ml |
| Solution III | | |
| deionized water | 200 | ml |
| sodium chloride | 13.6 | g |
| potassium bromide | 0.28 | g |
| Solution IV | | |
| deionized water | 200 | ml |
| silver nitrate | 40 | g |
| Solution V | | |
| deionized water | 400 | ml |
| sodium chloride | 27.25 | g |
| potassium bromide | 0.56 | g |
| Solution VI | | |
| deionized water | 400 | ml |
| silver nitrate | 80 | g |

The solution I was dissolved at 55° C., followed by the addition of the solution II. After one minute, the solutions III and IV were simultaneously added to the obtained mixture over a period of 20 minutes. The mixture thus obtained was ripened for 10 minutes. The solutions V and VI were simultaneously added to the resulting mixture over a period of 30 minutes, followed by ripening for 10 minutes. After the completion of physical ripening, the resulting emulsion was freed from excess salts by the process described in Example 1 of U.S. Pat. No. 2,613,928. Water and gelatin were added to the resulting emulsion, followed by re-dissolution. The obtained emulsion was adjusted to a pH of 6.0 and then to a temperature of 55° C. Sodium thiosulfate was added to the emulsion to conduct optimal chemical sensitization. The resulting emulsion was cooled to 40° C, followed by the addition of sensitizing dyes A, B and C respectively in amounts of $1\times10^{-4}$ mol, $1.3\times10^{-4}$ mol and $4\times10^{-5}$ mol per mol of silver. The emulsion thus obtained was allowed to stand for 20 minutes, followed by the addition of 4-hydroxy-6-methyl-1,3,3a,7-tetraazaindene in an amount of 50 mg per mol of the silver halide.

Sensitizing dye

A

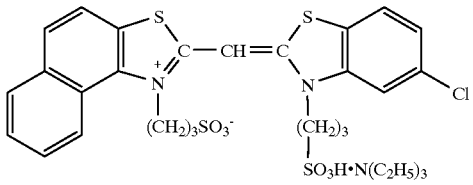

-continued

B

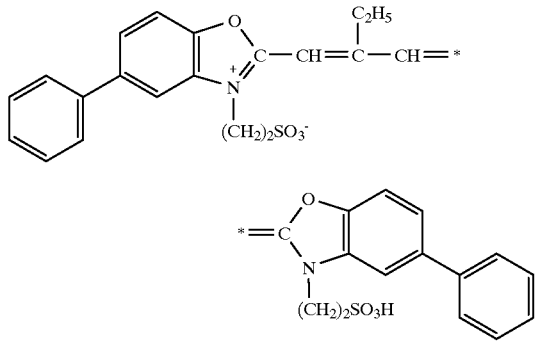

C

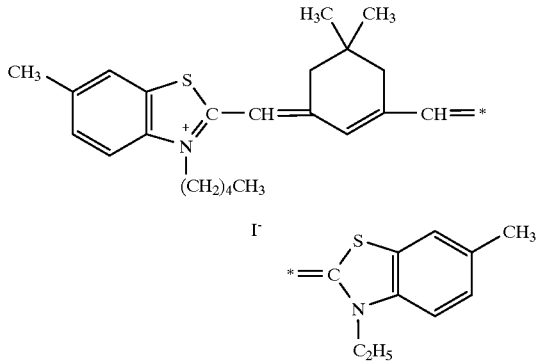

A coupler dispersion was prepared as follows.

Couplers were dissolved in a mixture of dibutyl phthalate with ethyl acetate and the obtained solution was added to an aqueous solution of gelatin in the presence of a surfactant. The resulting mixture was finely dispersed by the use of an ultrasonic homogenizer.

The silver halide emulsion prepared above was mixed with the coupler dispersion prepared above. The resulting mixture was applied onto a polyethylene-coated paper simultaneously with the formation of two other layers in such a way as to give the following layer configuration.

| | | |
|---|---|---|
| Top protective layer | | |
| gelatin | 1.0 | $g/m^2$ |
| Compound I-1 | 0.5 | $g/m^2$ |
| Ultraviolet absorbing layer | | |
| ultraviolet absorber A | 0.15 | $g/m^2$ |
| ultraviolet absorber B | 0.20 | $g/m^2$ |
| high-boiling solvent | 0.2 | $g/m^2$ |
| gelatin | 0.6 | $g/m^2$ |
| Silver halide emulsion layer | | |
| silver halide emulsion | 0.7 (in terms of silver) | $g/m^2$ |
| coupler (C-1) | 0.37 | $g/m^2$ |
| coupler (M-1) | 0.17 | $g/m^2$ |
| coupler (Y-1) | 0.68 | $g/m^2$ |
| high-boiling solvent | 1 | $g/m^2$ |
| gelatin | 1.5 | $g/m^2$ |
| irradiation-inhibiting dye A | 0.03 | $g/m^2$ |
| irradiation-inhibiting dye B | 0.03 | $g/m^2$ |
| Base polyethylene-coated paper | | |

The couplers and other additives used in Example 1 are as follows:

| High-boiling solvent | di-n-butyl phthalate |
|---|---|

C-1

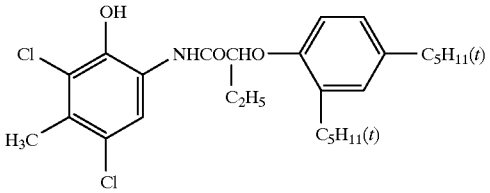

M-1

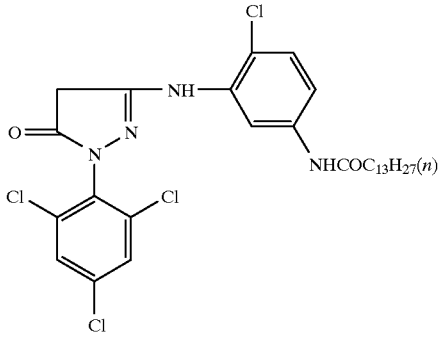

Y-1

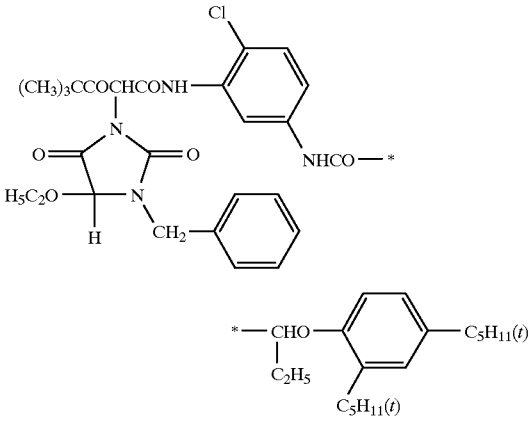

Irradiation-inhibiting dye

A

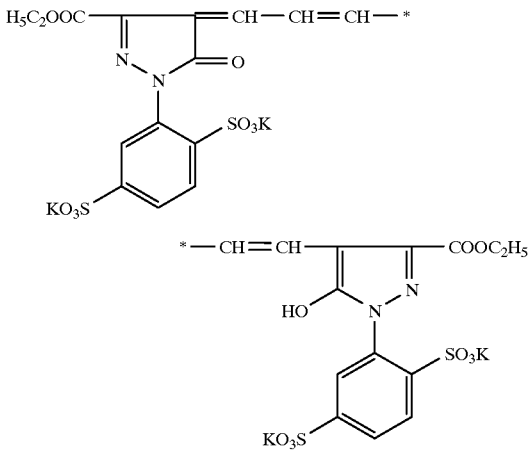

-continued

B

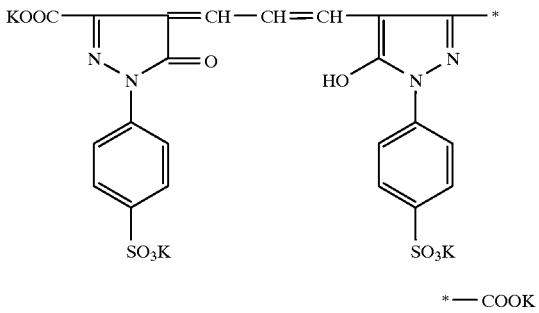

Ultraviolet absorbing layer A

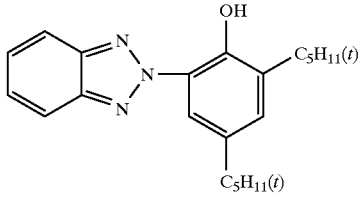

Ultraviolet absorbing layer B

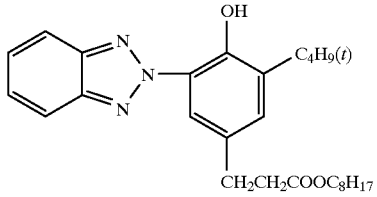

Thus, Sample 1 according to the present invention was prepared. A sample for comparison (Sample 2) was prepared in the same manner as that employed in preparing Sample 1 except that Compound I-1 was not used in preparing the protective layer. Further, another sample for comparison (Sample 3) was prepared in the same manner as that employed in preparing Sample 1 except that Compound I-1 was replaced by Comparative Compound A in the same amount as that of Compound I-1.

Comparative Compound

A

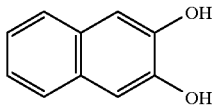

These samples were exposed by the use of a sensitometer (color temperature of light source: 3200 K) through an optical wedge, and then subjected to the following treatments:

Treatment 1

Each sample was kept at 30° C. for 3 days in a hermetically sealed container in which a liquid containing 300 ml of a 35% aqueous solution of glycerol was placed on the bottom and which was filled with the air equilibrated with the liquid.

Treatment 2

Each sample was kept at 30° C. for 3 days in a hermetically sealed container in which a liquid containing 300 ml of a 35% aqueous solution of glycerol and 6 ml of a 40% aqueous solution of formaldehyde was placed on the bottom and which was filled with the air equilibrated with the liquid.

The samples which had undergone the above treatments were each subjected to the color development, bleach-fix and washing which will be described below, and then dried.

| Processing step | Temp. | Time |
|---|---|---|
| color development | 35° C. | 45 s |
| bleach-fix | 35° C. | 45 s |
| washing | 35° C. | 90 s |

| Color developer | |
|---|---|
| 4-amino-3-methyl-N-ethyl-N-(β-methylsulfonamidoethyl)aniline sesquisulfate monohydrate | 6.1 g |
| triethanolamine | 8.2 g |
| nitrilotriacetic acid | 1.5 g |
| 1-hydroxyethylidene-1,1'-diphosphonic acid (60% aqueous solution) | 1.6 g |
| potassium hydroxide | 4.2 g |
| Tinopal SFP | 0.8 g |
| potassium carbonate | 0.9 g |
| N,N-diethylhydroxylamine | 4.0 g |

Water was added to make up to a total volume of one liter, and the pH of the resulting solution was adjusted to 10.10 with a 10% aqueous solution of sulfuric acid or a 20% aqueous solution of potassium hydroxide. Tinopal SFP is a fluorescent whitening agent of Ciba-Geigy AG.

| Bleach-fix bath | | |
|---|---|---|
| iron (III) sodium ethylenediaminetetraacetate monohydrate | 48.0 | g |
| disodium ethylenediaminetetraacetate dihydrate | 24.0 | g |
| ammonium thiosulfate (70% aqueous solution) | 148 | ml |
| sodium hydrogensulfite (anhydrous) | 15.0 | g |

Water was added to make up to a total volume of one liter, and the pH of the resulting solution was adjusted to 6.10 with 25% aqueous ammonia or 90% acetic acid.

| Washing bath | | |
|---|---|---|
| methanol | 4.0 | ml |
| n-butyl p-hydroxybenzoate | 0.01 | g |
| thiabendazole | 0.10 | g |
| ethylene glycol | 6.0 | ml |

Water was added to make up to a total volume of one liter. The pH of the resulting bath was 7.45.

The resulting samples were each examined for maximum densities of yellow, magenta and cyan, and tone. The results are given in Table 1.

TABLE 1

| Sample No. | Treatment | density of yellow | density of magenta | density of cyan | color tone |
|---|---|---|---|---|---|
| 1 (Invention) | 1 | 2.52 | 2.63 | 2.55 | black |
| 1 (Invention) | 2 | 2.50 | 2.37 | 2.52 | black |
| 2 (Comparative) | 1 | 2.56 | 2.60 | 2.49 | black |
| 2 (Comparative) | 2 | 2.51 | 1.45 | 2.47 | green |
| 3 (Comparative) | 1 | 2.55 | 2.61 | 2.51 | black |
| 3 (Comparative) | 2 | 2.52 | 1.88 | 2.47 | green |

It can be understood from the results given in Table 1 that Sample 1 according to the present invention is reduced in the lowering in maximum density of magenta due to Treatment 2 as compared with Sample 2 (for comparison), and the tone of the former is black. Further, it can also be understood that Sample 3 (for comparison) exhibits a more significant lowering in the maximum density of magenta than that of Sample 1, though the lowering of Sample 3 is smaller than that of Sample 2.

Example 2

A sample according to the present invention (Sample 4) was prepared in the same manner as that employed in Example 1 for preparing Sample 1 except that the couplers were replaced by C-2 (0.33 g/m$^2$), M-2 (0.15 g/m$^2$) and Y-2 (0.55 g/m$^2$) and Compound I-1 was replaced by Compound II -1 (0.3 g/m$^2$). Further, a sample for comparison (Sample 5) was prepared in the same manner as that employed in preparing Sample 4 except that Compound II-1 was not used in preparing the protective layer. Additionally, another sample for comparison (Sample 6) was prepared in the same manner as that employed in preparing Sample 4 except that Compound II-1 was replaced by Comparative Compound A in the same manner as that of Compound II-1.

C-2

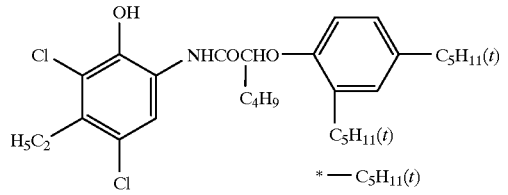

M-2

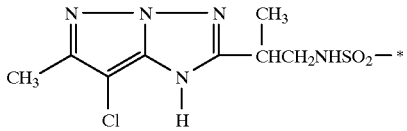

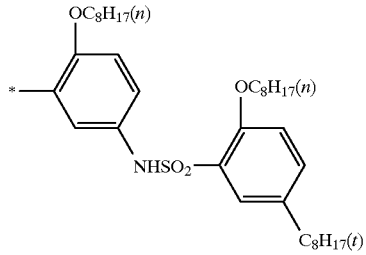

Y-2

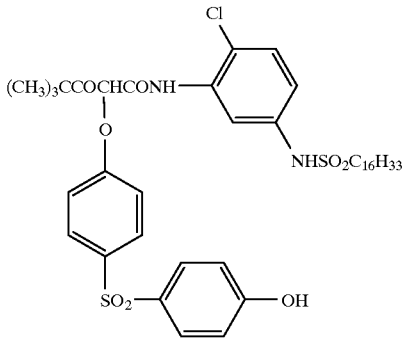

In a similar manner to that of Example 1, Samples 4 to 6 were subjected to exposure, Treatments 1 and 2 and development. The resulting samples were examined for maximum densities of yellow, magenta and cyan, and tone. The results are given in Table 2.

TABLE 2

| Sample No. | Treatment | density of yellow | density of magenta | density of cyan | color tone |
|---|---|---|---|---|---|
| 4 (Invention) | 1 | 2.48 | 2.68 | 2.63 | black |
| 4 (Invention) | 2 | 2.51 | 2.45 | 2.60 | black |
| 5 (Comparative) | 1 | 2.50 | 2.61 | 2.59 | black |
| 5 (Comparative) | 2 | 2.47 | 2.04 | 2.55 | green |
| 6 (Comparative) | 1 | 2.49 | 2.62 | 2.57 | black |
| 6 (Comparative) | 2 | 2.47 | 2.23 | 2.54 | green |

It can be understood from the results given in Table 2 that Sample 4 according to the present invention is reduced in the lowering in maximum density of magenta due to Treatment 2 as compared with Sample 5 (for comparison), and the tone of the former is black. Further, it can also be understood that Sample 6 (for comparison) exhibits amore significant lowering in the maximum density of magenta than that of Sample 4, though the lowering of Sample 6 is smaller than that of Sample 5.

Example 3

A silver chloride—silver bromide emulsion (a cubic monodispersion, 0.5 $\mu$m of an average particle size, 0.9% by mol of a ratio containing the silver bromide, containing $1\times10^{-5}$ mol of potassium hexachloro iridate (IV) per mol of silver onto a surface of the particles) was prepared and added with a sodium thiosulfate. The resultant was chemically sensitized optimally, so that the resultant was added with $1\times10^{-4}$ mol of sensitizing dye A, $1.3\times10^{-4}$ mol of sensitizing dye B, and $4\times10^{-5}$ mol of sensitizing dye C per mol of the silver. The resultant thus obtained was allowed to stand for 20 minutes, followed by the addition of 4-hydroxy-6-methyl-1,3,3a,7-tetraazaindene in an amount of 50 mg per mol of the silver halide.

A coupler dispersion was prepared as follows.

After a coupler was dissolved in dibutyl phthalate and ethyl acetate, the coupler added in an aqueous gelatin solution was dispersed in the presence of surfactants using an ultrasonic homogenizer.

The silver halide emulsion prepared above was mixed with the coupler dispersion prepared above. The resulting mixture was applied onto a polyethylene-coated paper simultaneously with the formation of two other layers in such a way as to give the following layer configuration.

| | | |
|---|---|---|
| Top protective layer | | |
| gelatin | 1.0 | g/m$^2$ |
| Compound | shown in Table 3 | |
| Ultraviolet absorbing layer | | |
| ultraviolet absorber A | 0.15 | g/m$^2$ |
| ultraviolet absorber B | 0.20 | g/m$^2$ |
| high-boiling solvent | 0.2 | g/m$^2$ |
| gelatin | 0.6 | g/m$^2$ |
| Silver halide emulsion layer | | |
| silver halide emulsion | 0.7 (in terms of silver) | g/m$^2$ |

-continued

| | | |
|---|---|---|
| coupler (C-3) | 0.37 | g/m$^2$ |
| coupler (M-1) | 0.17 | g/m$^2$ |
| coupler (Y-1) | 0.68 | g/m$^2$ |
| high-boiling solvent | 1 | g/m$^2$ |
| gelatin | 1.5 | g/m$^2$ |
| irradiation-inhibiting dye A | 0.03 | g/m$^2$ |
| irradiation-inhibiting dye B | 0.03 | g/m$^2$ |
| Compound | shown in Table 3 | |
| Base polyethylene-coated paper | | |

The coupler used in Example 3 is as follows:

High-boiling solvent di-*n*-butyl phthalate

C-3

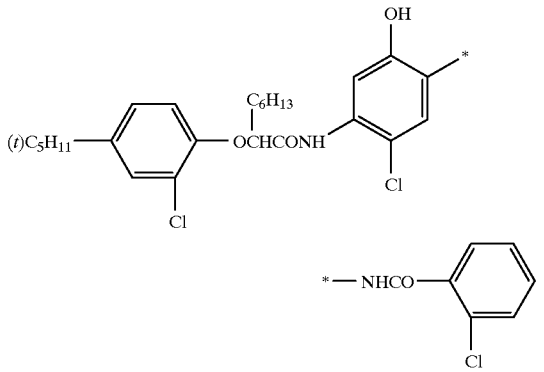

TABLE 3

| Sample No. | Compound in the protective layer (g/m$^2$) | Compound in the emulsion (g/m$^2$) |
|---|---|---|
| 7 (Comparative) | none | none |
| 8 (Comparative) | Comparative Compound A (0.3) | Comparative Compound A (0.3) |
| 9 (Invention) | I-1 (0.3) | none |
| 10 (Invention) | I-1 (0.6) | none |
| 11 (Invention) | none | I-1 (0.3) |
| 12 (Invention) | none | I-1 (0.6) |
| 13 (Invention) | I-1 (0.3) | I-1 (0.3) |
| 14 (Invention) | I-1 (0.6) | I-1 (0.6) |

Thus, Samples 7 to 14 in the present invention was prepared as shown Table 3.

These samples were exposed by the use of a sensitometer (color temperature of light source: 3200 K) through an optical wedge, and then subjected to the aforementioned Treatment 1 and 2.

The resulting samples were each examined for maximum densities of yellow, magenta and cyan, and tone. The results are given in Table 4.

TABLE 4

| Sample No. | Treatment | density of yellow | density of magenta | density of cyan | color tone of the whole sheet | color tone of the sheet-edge |
|---|---|---|---|---|---|---|
| 7 (Comparative) | 1 | 2.51 | 2.62 | 2.56 | black | black |
| 7 (Comparative) | 2 | 2.45 | 1.37 | 2.40 | green | green |
| 8 (Comparative) | 1 | 2.53 | 2.64 | 2.54 | black | black |
| 8 (Comparative) | 2 | 2.47 | 1.65 | 2.41 | green | green |
| 9 (Invention) | 1 | 2.48 | 2.61 | 2.50 | black | black |
| 9 (Invention) | 2 | 2.46 | 2.58 | 2.47 | black | green |
| 10 (Invention) | 1 | 2.53 | 2.61 | 2.55 | black | black |
| 10 (Invention) | 2 | 2.50 | 2.59 | 2.53 | black | green |
| 11 (Invention) | 1 | 2.49 | 2.58 | 2.51 | black | black |
| 11 (Invention) | 2 | 2.48 | 2.55 | 2.49 | black | black |
| 12 (Invention) | 1 | 2.53 | 2.65 | 2.57 | black | black |
| 12 (Invention) | 2 | 2.51 | 2.63 | 2.55 | black | black |
| 13 (Invention) | 1 | 2.50 | 2.60 | 2.54 | black | black |
| 13 (Invention) | 2 | 2.50 | 2.58 | 2.53 | black | black |
| 14 (Invention) | 1 | 2.45 | 2.55 | 2.53 | black | black |
| 14 (Invention) | 2 | 2.44 | 2.54 | 2.51 | black | black |

It can be understood from the results given in Table 4 that each of Sample 7 and Sample 8 for comparison in the present invention are lowering the density of magenta due to Treatment 2 and the tone of a whole sheet is green. Sample 7 contains no compounds represented by the general formula (I) and Sample 8 contains Comparative Compound A. The other hand, the protective layers in each of Sample 9 and 10 contain the compounds represented by the general formula (I), and then the tone of a whole sheet is black. Furthermore, Sample 11 to 14 in the present invention is reduced lowering in the maximum density of magenta due to Treat 2, and the tone of not only a whole sheet but also a sheet-edge are black.

Example 4

Samples 15 to 18 are prepared as the same manner of Sample 7 except for that the coupler at Sample 7 in Example 3 is substituted for the aforementioned C-2 (an amount of 0.33 g/m$^2$), M-2 (an amount of 0.15 g/m$^2$), and Y-2 (an amount of 0.55 g/m$^2$) and that Compound shown in Table 3 is substituted for Compound shown in Table 5.

TABLE 5

| Sample No. | Compound in the protective layer (g/m$^2$) | Compound in the emulsion (g/m$^2$) |
|---|---|---|
| 15 (Comparative) | none | none |
| 16 (Invention) | II-1 (0.5) | none |
| 17 (Invention) | none | II-1 (0.5) |
| 18 (Invention) | II-1 (0.5) | II-1 (0.5) |

In a similar manner to that of Example 3, Samples 15 to 18 were subjected to exposure, Treatments 1 and 2 and development. The resulting samples were examined for maximum densities of yellow, magenta and cyan, and tone. The results are given in Table 6.

TABLE 6

| Sample No. | Treatment | density of yellow | density of magenta | density of cyan | color tone of the whole sheet | color tone of the sheet-edge |
|---|---|---|---|---|---|---|
| 15 (Comparative) | 1 | 2.51 | 2.62 | 2.56 | black | black |
| 15 (Comparative) | 2 | 2.45 | 1.37 | 2.40 | green | green |
| 16 (Invention) | 1 | 2.55 | 2.61 | 2.58 | black | black |
| 16 (Invention) | 2 | 2.53 | 2.57 | 2.54 | black | green |
| 17 (Invention) | 1 | 2.54 | 2.60 | 2.57 | black | black |
| 17 (Invention) | 2 | 2.52 | 2.58 | 2.54 | black | black |
| 18 (Invention) | 1 | 2.52 | 2.60 | 2.55 | black | black |
| 18 (Invention) | 2 | 2.51 | 2.59 | 2.53 | black | black |

It can be understood from the results given in Table 6 that the tone of not only a whole sheet but also a sheet-edge are black in spite of Treatment 2 in the each case of Sample 17 and Sample 18 in the present invention. Besides, it can be understood that the tone of the whole sheet is black in spite of Treat 2 in the case of Sample 16 in which the protective layer contains Compound shown Table 5 in the present invention. On the other hand, it can be understood that the tone of a whole sheet and a sheet-edge are green due to Treat 2 in the case of Sample 15.

As described above, the silver halide photographic material of the present invention can give a black-and-white picture by the use of dye images through processing with a color developer substantially free from benzyl alcohol, and little suffers from the deterioration of photographic characteristics by harmful gas such as formaldehyde.

What is claimed is:

1. A silver halide photographic material comprising a base and at least one silver halide emulsion layer formed on the base, in which a silver chloride content of silver halide grain of the silver halide emulsion layer is 95 mole % or above; the silver halide emulsion layer contains a yellow coupler, a magenta coupler and a cyan coupler; and the silver halide emulsion and/or other hydrophilic colloid layer contains at least one compound selected from the group consisting of compounds having the formulae (I) and (II):

Chemical Formula (I)

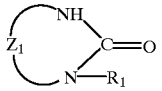

wherein $R_1$ is hydrogen, a $C_1$–$C_4$ alkyl or an acyl; and $Z_1$ is an ethylene chain or a trimethine chain, Chemical Formula (II)

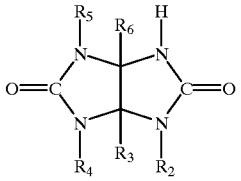

wherein $R_2$, $R_3$, $R_4$, $R_5$ and $R_6$ are each hydrogen, a $C_1$–$C_4$ alkyl, an aryl or an aralkyl.

2. The material as claimed in claim 1, which comprises the base, at least one silver halide emulsion layer and a hydrophilic colloid layer, in which at least one of the silver halide emulsion layer and the hydrophilic colloid layer contains at least one compound selected from the group consisting of compounds having the formulae (I) and (II).

3. The material as claimed in claim 2, in which the hydrophilic colloid layer is disposed on the silver halide emulsion layer and the hydrophilic colloid layer contains at least one compound selected from the group consisting of compounds having the formulae (I) and (II).

4. A process for forming photographic images, which comprises steps of exposing the material as defined in claim 1 to light carrying images and developing the material with a color developer being substantially free from benzyl alcohol.

* * * * *